US005192489A

United States Patent [19]

Metz et al.

[11] Patent Number: 5,192,489

[45] Date of Patent: Mar. 9, 1993

[54] DEVICE FOR OPENING THE TAPHOLE OF A SHAFT FURNACE

[75] Inventors: Jean Metz; Pierre Mailliet; Henri Radoux, Bereldange, all of Luxembourg

[73] Assignee: Paul Wurth S.A., Luxembourg, Luxembourg

[21] Appl. No.: 462,415

[22] Filed: Jan. 9, 1990

[30] Foreign Application Priority Data

Jan. 16, 1989 [LU] Luxembourg ..... 87427

[51] Int. Cl.[5] ..... E21B 19/00

[52] U.S. Cl. ..... 266/271; 269/234; 269/254 CS; 254/29 R

[58] Field of Search ..... 254/29 R, 29 A, 31, 254/1; 269/254 CS, 234; 266/271

[56] References Cited

U.S. PATENT DOCUMENTS 2,893,275 7/1959 Lindemann ..... 269/234
4,378,186 3/1983 Alexandre ..... 269/234
4,502,665 3/1985 Yoder ..... 254/29 R
4,602,770 7/1986 Mailliet et al. ..... 266/271
4,747,581 5/1988 Mailliet et al. ..... 266/99
4,842,248 6/1989 Shy ..... 254/29 R

FOREIGN PATENT DOCUMENTS 0128432 12/1984 European Pat. Off. .
819801 10/1937 France .
2520857 1/1983 France .

OTHER PUBLICATIONS

Chem. Tech. 10 Jg, Heft. 7, Jul. 1958 pp. 405–407.

*Primary Examiner*—J. J. Swann
*Attorney, Agent, or Firm*—Fishman, Dionne & Cantor

[57] ABSTRACT

A method for opening the taphole of a shaft furnace by withdrawing a rod, held in the hardened sealing compound of the taphole, includes engaging a coupling device onto the end of the rod, gripping the rod using a clamp longitudinally displaceable by a hydraulic jack, pulling out the rod by a length corresponding to the stroke of the jack and repeating this operation until the rod is completely withdrawn from the taphole.

5 Claims, 3 Drawing Sheets

DEVICE FOR OPENING THE TAPHOLE OF A SHAFT FURNACE

TECHNICAL FIELD

The present invention relates to a method and device for opening the taphole of a shaft furnace by withdrawing a rod held in the hardened sealing compound of the taphole.

BACKGROUND

Typically, a taphole is sealed by a rod held in the taphole by a hardened sealing compound. In order to be able to withdraw this type of rod, a relatively substantial force must be deployed. Conventional work tools have a powerful pneumatic striking pin for this purpose. A striking pin of this type has the disadvantage, however, that it entails considerable stresses on the material, in particular on its device for coupling with the rod which, as a result, is subjected to rapid wear and to the necessity of frequent replacement. A pneumatic striking pin has the further disadvantage of being very noisy.

The document EP-B2-0,128,432 (corresponding to commonly assigned U.S. Pat. No. 4,602,770) proposes, in order to overcome these disadvantages, the use of a powerful hydraulic jack to unlock the rod from its hardened sealing compound by retracting the mount together with the rod by sliding along the jack. However, as well as being fairly complicated, this machine does not enable the rod to be completely withdrawn, only unlocked. It is therefore the work tool which must perform the withdrawal of the rod and, consequently, deploy a relatively substantial force until the rod has been completely released from the sealing compound. The object of the present invention is to provide a method and a device which enable the above disadvantages to be avoided and the rod to be withdrawn completely using a hydraulic jack.

SUMMARY OF THE INVENTION

In order to achieve this goal, the method proposed by the Present invention is characterized in that, after having engaged the coupling means onto the free end of the rod, the latter is gripped by a clamp which is longitudinally displaceable under the action of a hydraulic jack, and in that the rod is pulled out by a length corresponding to the stroke of the jack and in that this operation is repeated until the rod is completely withdrawn from the taphole.

The device for implementing this method is characterized by a clamp fitted to the front end of the mount, axially aligned on the coupling device and longitudinally displaceable relative to the mount under the action of a hydraulic jack fitted on the latter.

The clamp has an axial channel for the passage of the rod, and two symmetrical jaws which are obliquely displaceable relative to the said channel in a direction enlarging or narrowing the latter.

According to a preferred embodiment, each of the jaws is actuated by the hydraulic fluid of the said jack which urges them in a direction narrowing the said channel and by a spring in the opposite direction.

According to another embodiment, each of the jaws is subjected to the action of a spring which urges them in a direction narrowing the said channel.

The work tool is fitted slideably on a carriage which is, in turn, fitted slideably on the mount.

DETAILED DESCRIPTION OF THE INVENTION

Figure 1:
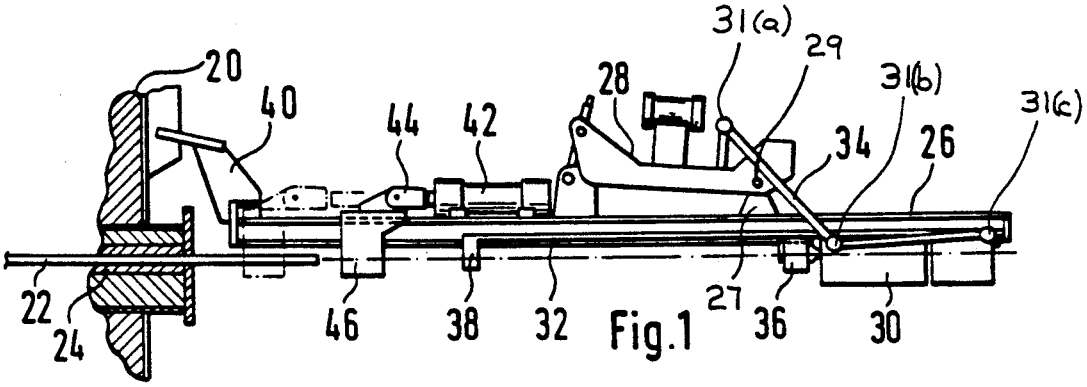
FIGS. 1 to 8 illustrate, in diagrammatic side views, the different stages of freeing and withdrawing a rod from a taphole.
Figure 2:
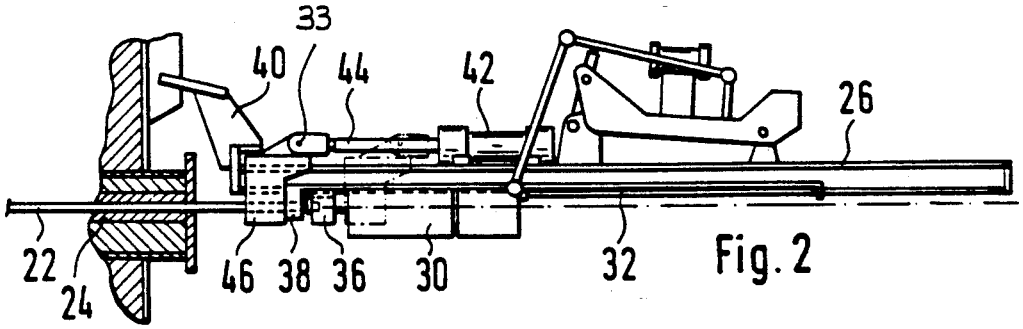
Figure 3:
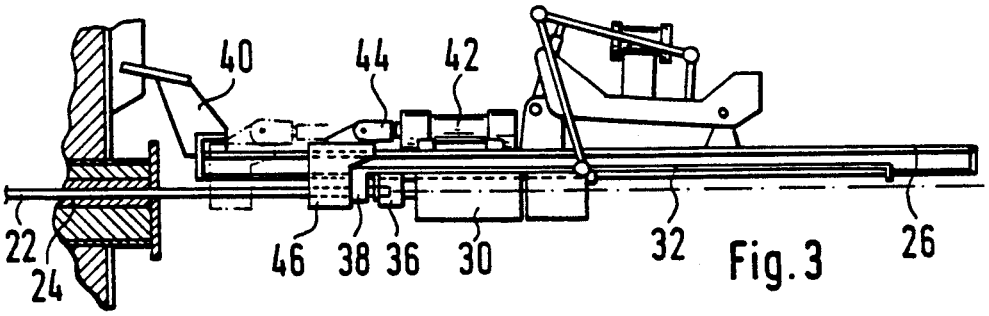

FIGS. 1 to 8 show diagrammatically a machine designed to open a taphole of a shaft furnace 20, either by traditional boring or, as shown in the figures, by withdrawing a rod 22 locked in the hardened sealing compound 24. As shown in FIG. 1, the machine has a mount 26 with a bracket 27 extending therefrom which is pivotally carried at the end of a support arm 28, by virtue of pivot pin 29 so that mount 26 pivots relative to arm 28 by pivotal movement about the axis of pivot pin 29 between the operating position shown in the figures and a storing position at a distance from the taphole. A work tool 30 is fitted slideably on a moveable carriage 32, (using any known and appropriate means such as the rollers depicted in a aforementioned U.S. Pat. No. 4,602,770 for slidably mounting a work tool 22 on a support 26, see column 3, lines 39–47 of U.S. Pat. No. 4,602,770) supported, in turn, slideably on the mount 26. The reference 34 denotes a duct which is articulated by virtue of the three joints 31(*a*), 31(*b*) and (*c*) as shown in FIG. 1. Duct 34 delivers to the work tool 30 pneumatic or hydraulic fluid.

A means 36 for coupling the work tool 30 to the free end of the rod 22 is situated at the front of this tool 30. It will be appreciated by one of ordinary skill in the art that coupling means 30 may be of known construction and is functionally analogous to the gripper element 24 identified in aforementioned U.S. Pat. No. 4,602,770. This coupling means is, preferably, of the type described in french Patent No. 2,520,857 which operates by gripping the end of the rod to transmit percussive blows from the working tool 30 to the rod 22.

Figure 8:
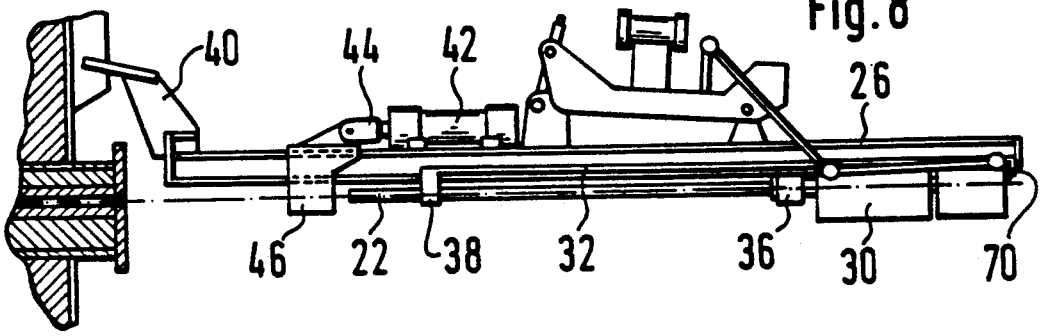

The front part of the carriage 32 is designed in the form of a support 38 for the rod 22, when rod 22 has been fully extracted and is therefore supported only by the support 38 and the coupling means 36, as is the case in the position in FIG. 8.

A bearing piece 40, which is in contact with the wall of the furnace, is positioned at the front end of the mount 26 in order to transmit any counter-reactive forces to the wall of the furnace when the rod is withdrawn.

Figure 9:
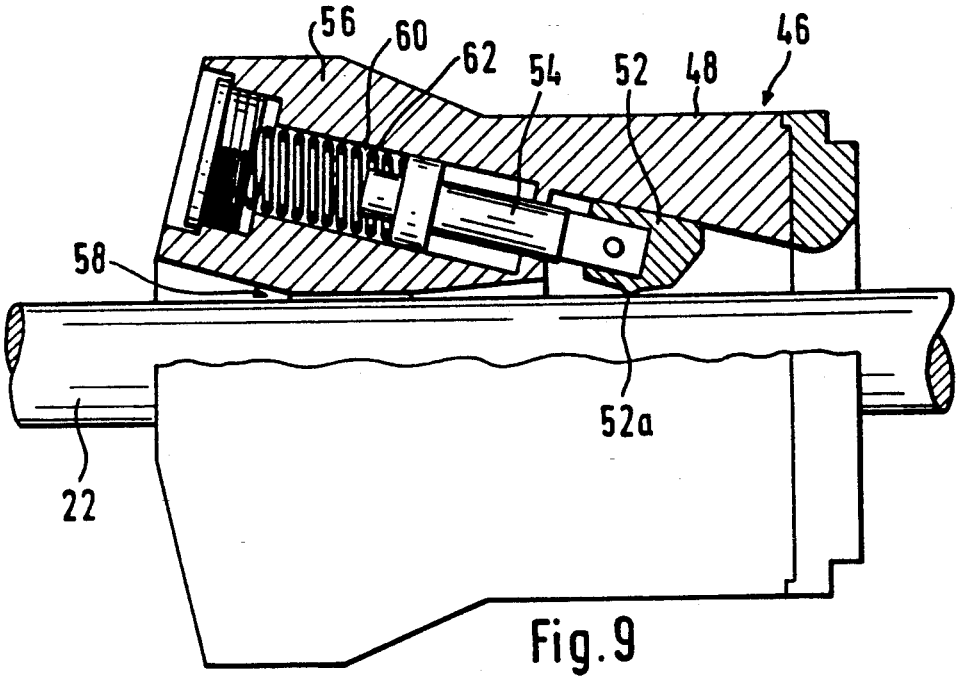
FIG. 9 shows diagrammatically a partial horizontal cross section of a first embodiment of a clamp for unlocking and pulling out a rod.
Figure 10:
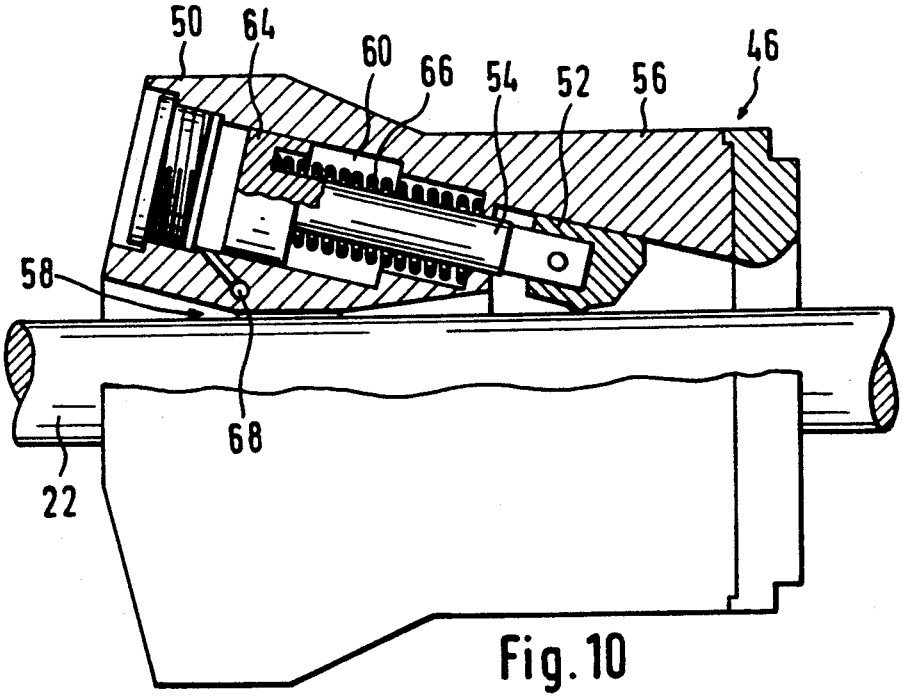
FIG. 10 shows a partial horizontal cross section of a second embodiment of a clamp for unlocking and pulling out a rod.

Furthermore, a hydraulic jack 42, the rod 44 of which is displaceable in the longitudinal direction of the mount 26, is situated at the front of the mount 26. A clamp 46, clamps piercing rod 22 for subsequent gripping by coupler means 36 (see FIG. 2) and which is shown in two embodiments, in horizontal cross-sections in FIGS. 9 and 10, is attached at the end of the piston rod 44 using a pivotal point 33 (see FIG. 2). In each of the two embodiments, the clamp 46 consists of two symmetrical side cheeks, only one of which is shown at 48 and 50 in FIGS. 9 and 10 respectively.

Each of the cheeks 48 and 50 essentially consists of a jaw 52 fitted to the end of a sliding rod 54, held in place and guided in a chamber 60 by a support block 56 which forms a unit with the corresponding symmetrical block of the second opposite cheek, not shown. Each of the blocks 56 defines, with its half which is not shown, a channel 58 which enables the rod 22, whose part on the right-hand side in FIGS. 9 and 10 is engaged in the taphole of the furnace, not shown in these figures, to pass through it.

As shown in FIGS. 9 and 10, the jaws 52 are obliquely displaceable relative to the rod 22 so as to be integrated with the latter by the penetration of an inner sharp ridge 52*a* into the surface of the rod 22 or so as to be freed from it by the retraction of the jaw and penetration of their rod 54 into the chambers 60.

The two embodiments in FIGS. 9 and 10 differ from each other only in the means employed for actuating the jaws 52 with a view to clamping the rod 22.

In the embodiment in FIG. 9, the rod 54 of the jaw 52 is subjected to the action of a double helical spring 62 which acts in the closing direction of the clamp 46 by pushing the jaw 52 towards the right-hand side in FIG. 9. Consequently, when the clamp 46 pulls on the rod 22 under the action of the jack 42 towards the left-hand side in FIG. 9 and towards the right-hand side in FIG. 1, it bites into the rod through the penetration of the ridges 52*a* into the substance of the rod, as a result of the inclination of the rods 54 relative to the pulling direction of the jack 42.

Conversely, when the jack 42 acts on the clamp 46 in the opposite direction, in other words towards the right in FIG. 9, the jaws 52 are pressed back, counter to the action of their springs 62, and the ridges 52*a* slide on the surface of the rod 22.

In the embodiment in FIG. 10, the clamp 46 is actuated pneumatically or hydraulically. In fact, in this embodiment, the end of the rod 54, opposite that of the jaw 52, is integral with a piston 64. A double helical spring 66, which acts in a direction opening the clamp 46 so as to draw the jaw 52 into the block 56, is situated around the rods. The chamber 60 is connected by a duct 68 to the pressure of a pneumatic or hydraulic means which acts on the head of the piston 64 on the side opposite the spring 66 and counter to the action of the latter, in a direction closing the clamp 46. According to an advantageous embodiment, the duct 68 is connected directly to the hydraulic jack 42, on the rod 44 side, with the result that, when the jack 42 is pressurized in order to pull on the rod 22 this same pressure is used to close the clamp. This is very advantageous as the force for closing the clamp 56 is the same as the force for pulling on the rod 22, with the result that there is virtually no risk of the clamp 46 sliding on the rod 22.

The operation of the clamps 46 can therefore be compared to that of the coupling 36, described in more detail in French Patent No. 2,520,857, except that the rod 22 must be able to traverse axially the clamp 46 over the rod's entire length.

The operation for withdrawing a rod 22 using the machine described hereinabove will now be described. After the machine has been placed in the operating position in FIG. 1, the jack 42 is actuated in order to extend piston rod 44 from jack 42 and engage the clamp 46 on the rod 22, up to the position ,shown in broken lines. At the same time, since the work tool 30 is slidable relative to mount 26, the work tool is slidably advanced in a manner known per se, for example using an endless pull chain as shown at item 26 in FIG. 1 of U.S. Pat. No. 4,602,770 and described in Column 1, lines 44–47. From the moment the coupling 36 comes into contact with the front support 38 of the carriage 32, the latter is also carried along towards the furnace 20, up to the position in FIG. 2, in which the free end of the rod 22 penetrates the coupling 36 and may be gripped by the latter. In this position, according to FIG. 2, the work tool 30 is coupled to the rod 22 by closing the clamp of the coupling 36, while the jack 42 is actuated in order to draw in the piston rod 44. This operation closes the clamp 46 automatically, either by the action of the tensile force of the clamp on the rod 22 as in FIG. 9 or by hydraulic action as in FIG. 10. The jack 42 has a size such that its tensile force on the rod 22 is sufficient to unlock it from the compound 24 of the taphole and to pull it along when the clamp is moved back towards the position in broken lines in FIG. 2. During this movement, the clamp pulls along the carriage 32 with the coupling 36 and the tool 30 in a rearwards direction up to the position in FIG. 3.

Figure 4:
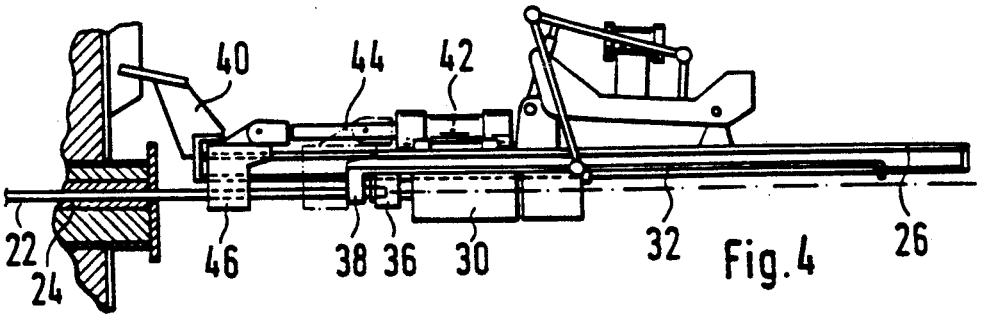

The jack 42 is then actuated again in the opposite direction in order to advance the clamp 46 as far as the position in FIG. 4. During this movement, the rod 22 is held in the position in FIG. 3, whereas the open clamp 46 can slide relative to the rod 22. When it has reached the position in FIG. 4, the jack 42 is actuated again in order to displace the clamp into the position in FIG. 5 and to release the rod 22 by an additional length corresponding to the stroke of the piston rod 44. During this backward movement of the clamp, the tool 30 is pushed back by the rod 22 as far as the position in FIG. 5, whereas the carriage 32 remains stationary at the same place on the mount 26.

Figure 5:
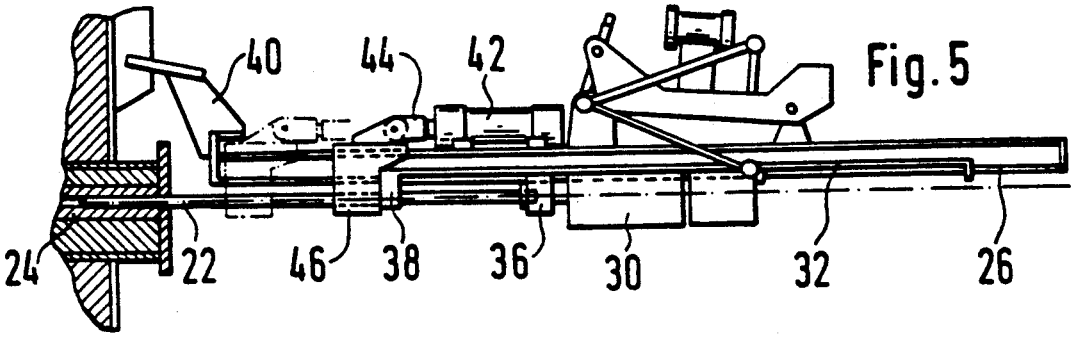
Figure 6:
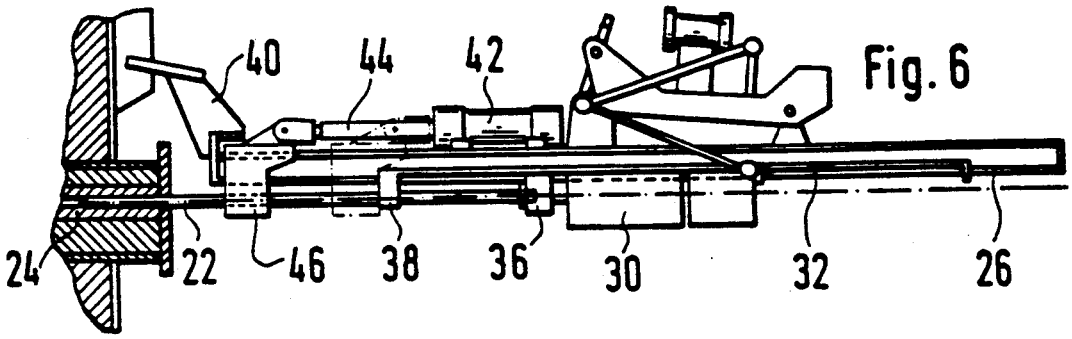
Figure 7:
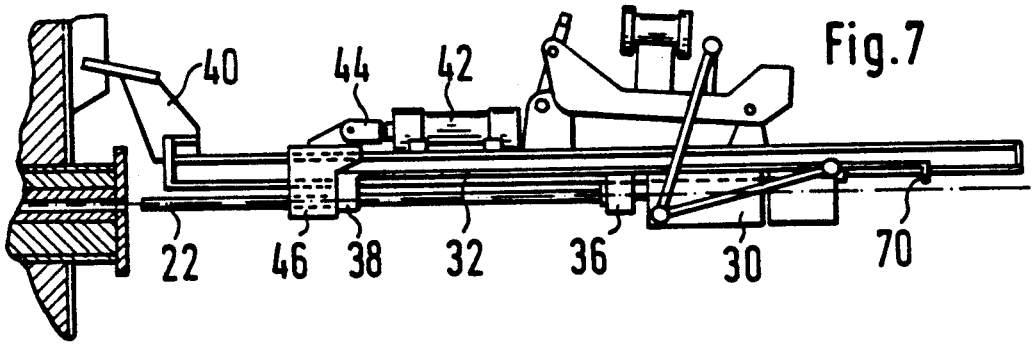

In this position in FIG. 5, after two stages of pulling on the rod 22, the latter has still not entirely come out, with the result that the jack 42 is actuated in order to perform a third back and forth movement corresponding to FIGS. 6 and 7 to withdraw the rod 22 completely, as indicated in FIG. 7. During this final pulling, the work tool 30 is pushed back by the rod 22 by a corresponding length towards the position in FIG. 7, whereas the carriage 32 stays in place the whole time.

In the position in FIG. 7, the clamp has fulfilled its purpose the rod having completely parted from the compound of the taphole. The final stage consists in displacing the work tool 30 into the starting position, (using the same mechanism which initially advanced the work tool such as the endless pull chain of U.S. Pat. No. 4,602,779) at the same time also pulling along the carriage 32 from the position in FIG. 7 into the position in FIG. 8, by catching a limit stop 70 at the rear of the carriage 32. As is shown in the FIGURES, the carriage 32 includes a stop 70 for limiting rearward movement of the working tool 30 relative to the carriage 32. Since carriage 32 is slidably mounted on mount 26, upon contact of the rearwardly displaced work tool 30 with stop 70, cartridge 32 is carried backward by the further rearward displacement of working tool 30. Also, as is clear from FIGS. 7 and 8, stop 70 extends downwardly from carriage 32 and "catches" working tool 30 by contacting the rear surface or working tool 30. In the position in FIG. 8, the rod 22 is also completely released by hand from the clamp 46 and remains held in the support 38 of the carriage 32 while awaiting release.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for opening a taphole through a wall of a shaft furnace, said taphole being sealed by a rod held within the taphole by a hardened sealing compound, said rod extending axially in a first direction from the taphole to a free end, comprising:

a mount having a front end and a rear end, said front end being positioned in front of said taphole;

a working tool slidably displaced along said mount;

coupling means for coupling the free end of the rod to said working tool;

clamp means, slidably mounted on said mount between said front end of said mount and said working tool and axially aligned with the coupling means, for gripping the rod as the rod passes through said clamp means;

hydraulic jack means, said hydraulic jack means having a preselected stroke distance, said jack means mounted on the front end of said mount and connected to said clamp means for displacing said clamp means along a limited path, said limited path corresponding to the stroke distance of said jack means.

2. The apparatus of claim 1, wherein the clamp means comprises:

a clamp body having an axial bore therethrough for permitting passage of the rod; and a pair of diametrically opposed jaws being displaceable relative to said bore in a gripping direction to constrict the bore and grip the rod and in a releasing direction, said direction being opposite the gripping direction, for releasing the rod.

3. The apparatus of claim 2, further comprising resilient means for urging the jaws in the releasing direction and second hydraulic jack means for displacing the jaws in the gripping direction to grip the rod.

4. The apparatus of claim 2, further comprising resilient means for urging the jaws in the gripping direction.

5. The apparatus of claim 1, wherein the coupling means comprises:

a carriage and a coupling body mounted on the carriage.

* * * * *